United States Patent [19]

Lockard

[11] Patent Number: 4,579,404

[45] Date of Patent: Apr. 1, 1986

[54] CONDUCTOR-TERMINATED CARD EDGE CONNECTOR

[75] Inventor: Joseph L. Lockard, Harrisburg, Pa.

[73] Assignee: AMP Incorporated, Harrisburg, Pa.

[21] Appl. No.: 652,778

[22] Filed: Sep. 20, 1984

Related U.S. Application Data

[63] Continuation-in-part of Ser. No. 536,017, Sep. 26, 1983, which is a continuation-in-part of Ser. No. 442,472, Nov. 17, 1982, abandoned.

[51] Int. Cl.[4] ..... H01R 4/66; H01R 13/405; H01R 4/02

[52] U.S. Cl. ..... 339/14 R; 339/176 MF; 339/176 MP; 339/218 M; 339/275 R; 339/276 R

[58] Field of Search ..... 339/176 MF, 176 MP, 339/218 R, 218 M, 176 M, 14 R, 276 R, 276 T, 275 R, 275 T

[56] References Cited

U.S. PATENT DOCUMENTS

| | | | |
|---|---|---|---|
| 3,315,218 | 4/1967 | Aker | 339/218 R |
| 3,548,365 | 12/1970 | Barker | 339/176 MP |
| 3,569,900 | 3/1971 | Uberbacher | 339/107 X |
| 3,610,874 | 10/1971 | Gagliano | 219/121 L |
| 3,634,806 | 1/1972 | Fergusson | 339/176 MF X |
| 3,731,251 | 5/1973 | Sinclair | 339/176 MF X |
| 3,740,698 | 6/1973 | Jerominek | 339/17 F |
| 3,864,010 | 2/1975 | Wasserlein, Jr. | 339/107 X |
| 3,864,011 | 2/1975 | Huber | 339/103 M |
| 3,878,318 | 4/1975 | Ziegler, Jr. et al. | 174/94 R |
| 4,043,630 | 8/1977 | Suverison et al. | 339/218 M |
| 4,269,466 | 5/1981 | Huber | 339/107 |
| 4,441,778 | 4/1984 | Sampson | 339/107 X |

OTHER PUBLICATIONS

*Electronics,* Sep. 22, 1981, pp. 149–154. "Dual Lasers Speed Termination of Flexible Printed Wiring"; Henderson.

*Primary Examiner*—Gil Weidenfeld
*Assistant Examiner*—Steven C. Bishop
*Attorney, Agent, or Firm*—Anton P. Ness

[57] ABSTRACT

A card edge connector is provided having two rows of paired contact members having spring arm contact sections extending from a forward end therof, the contact members being secured on side surfaces of a dielectric contact-carrying member and each having a conductor-connecting section to which is terminated either a signal conductor or a pair of ground conductors of a single trilead cable respectively forming a signal contact member or a ground contact member. This terminated contact subassembly is preferably overmolded with a dielectric material forming a housing sealingly securing the insulated end portions of the cables as a strain relief, the terminations and most of the body sections of the contacts, with the spring arm contact sections extending forwardly to receive a card edge. The housing may have latching features molded therein.

22 Claims, 7 Drawing Figures

CONDUCTOR-TERMINATED CARD EDGE CONNECTOR

CROSS-REFERENCE TO RELATED APPLICATIONS

This application is a continuation-in-part application of U.S. patent application Ser. No. 536,017 filed Sept. 26, 1983, which is a continuation-in-part of U.S. patent application Ser. No. 442,472 filed Nov. 17, 1982, now abandoned.

FIELD OF THE INVENTION

This invention relates to electrical connectors and more particularly to a card edge connector in which electrical conductors of electrical cables are terminated to contact members and the terminations are sealingly secured in a housing that supports the cables.

BACKGROUND OF THE INVENTION

It is desired in certain applications that a card edge connector be terminated to signal and ground conductors of conductor cables. It is also desired that such a connector be constructed to minimize losses or irregularities in the signals being transmitted from or to the transmission source to or from the printed circuit board, which in turn may be detachably connected to electrical equipment, or to another electrical connector such as a connector mounted to a printed circuit board, the intermediate board being used as an adaptor. The construction of the card edge connector must also be concerned with electrical performance characteristics so that they are not affected by wear and handling that results when equipment is moved and detachable connection and reconnection with other connectors take place.

SUMMARY OF THE INVENTION

According to the present invention, an electrical card edge connector comprises a dielectric contact-carrying member having signal contact members secured to one side thereof at spaced intervals therealong, and ground contact members similarly secured to the other side of the contact-carrying member at spaced intervals therealong. Contact sections of the signal and ground contact members extend outwardly from a front end of the contact-carrying member and are electrically engageable with associated conductors on side surfaces of an edge portion of a printed circuit board. Conductor-connecting sections of the signal and ground contact members extend along the contact-carrying member so that end portion of signal conductors and ground conductors of electrical cables are terminated respectively to the conductor-connecting sections. A dielectric housing is preferably overmolded over the assembly of contact-carrying member, contacts secured thereto, and termination sections and adjacent portions of the conductors and cables, with the contact sections extending forwardly to receive the edge portion of a printed circuit card. The housing may have latching members or means to secure the connector of the present invention to a mating connector.

DESCRIPTION OF THE PREFERRED EMBODIMENTS

Figure 1:
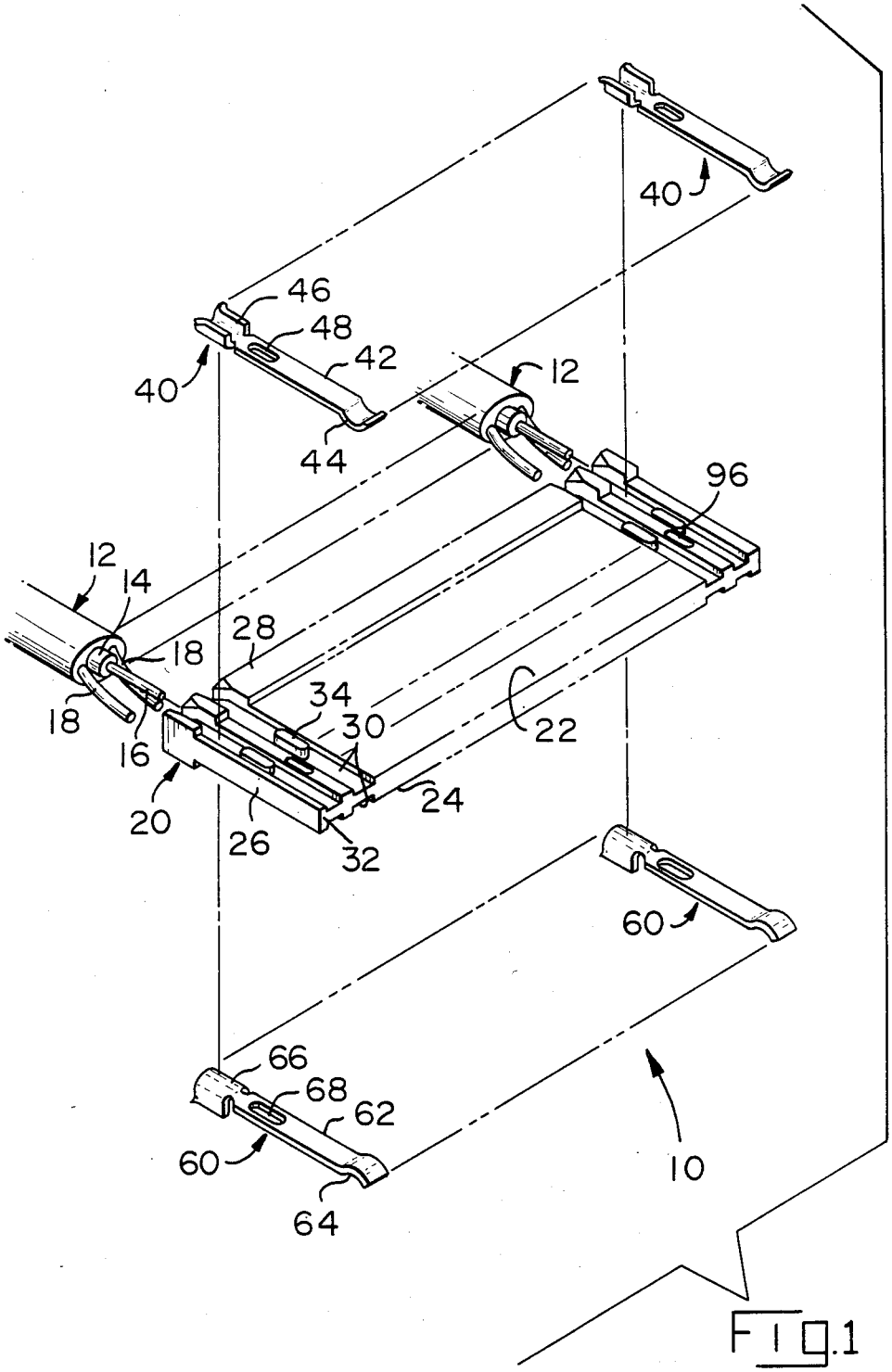
FIG. 1 is an exploded perspective view of the contact subassembly of the invention.

FIG. 1 illustrates contact subassembly 10 having a contact-carrying member 20, upper signal contacts 40 and lower ground contacts 60 to be secured to and disposed longitudinally along upper and lower surfaces 22, 24 respectively of body portion 26 of contact-carrying member 20, forwardly of conductor-receiving portion 28 of member 20. Signal and ground contacts 40, 60 preferably are stamped and formed of copper alloy and each have a generally planar body section 42, 62 extending along body portion 26 of member 20 preferably in shallow recesses 30 thereof, a spring arm contact section 44, 64 extending forwardly from planar body section 42, 62 and integral therewith and also extending forwardly beyond front end 32 of contact-carrying member 20, and a conductor-connecting section 46, 66 disposed just forwardly of conductor-receiving portion 28 of contact-carrying member 20.

Contact-carrying member 20 is molded from a dielectric material such as fluoropolymer or polyester plastic. Extending upward from upper surface 22 thereof preferably are projections 34 for engagement with corresponding holes 48 in planar body sections 42 of signal contacts 40 when signal contacts 40 are disposed against upper surface 22 of member 20, whereafter the outer ends of projections 34 are enlarged laterally by the application of pressure such as by cold staking, or by pressure and heat such as by heat staking thereby securing signal contacts 40 onto contact-carrying member 20.

Similarly, ground contacts 60 are secured to lower surface 24 by projections 34 extending below lower surface 24 through corresponding holes 68 of ground contacts 60, whose ends are then enlarged such as by cold staking or heat staking. Projections 34 are preferably oblong or oval in shape.

Figure 2:
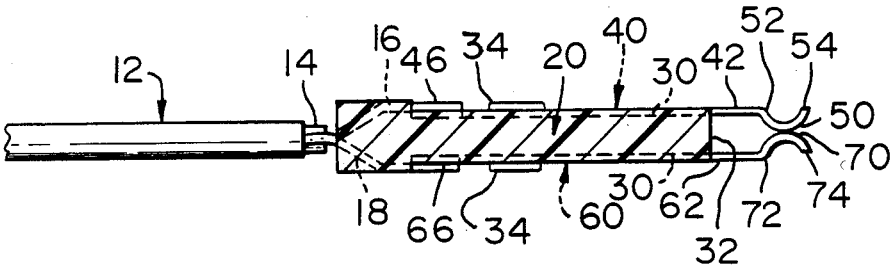
FIG. 2 is a longitudinal section view of the contact subassembly of FIG. 1.

As seen in FIGS. 1 and 2, signal contacts 40 and ground contacts 60 are preferably secured to member 20 in a parallel, paired arrangement such that signal and ground contact sections 44, 64 and signal and ground conductor-connecting sections 46, 66 are also paired. Signal contact sections 44 have contact surfaces 50 on downwardly arcuate sections 52 and also have short upwardly directed ends 54.

Figures 5, 7:
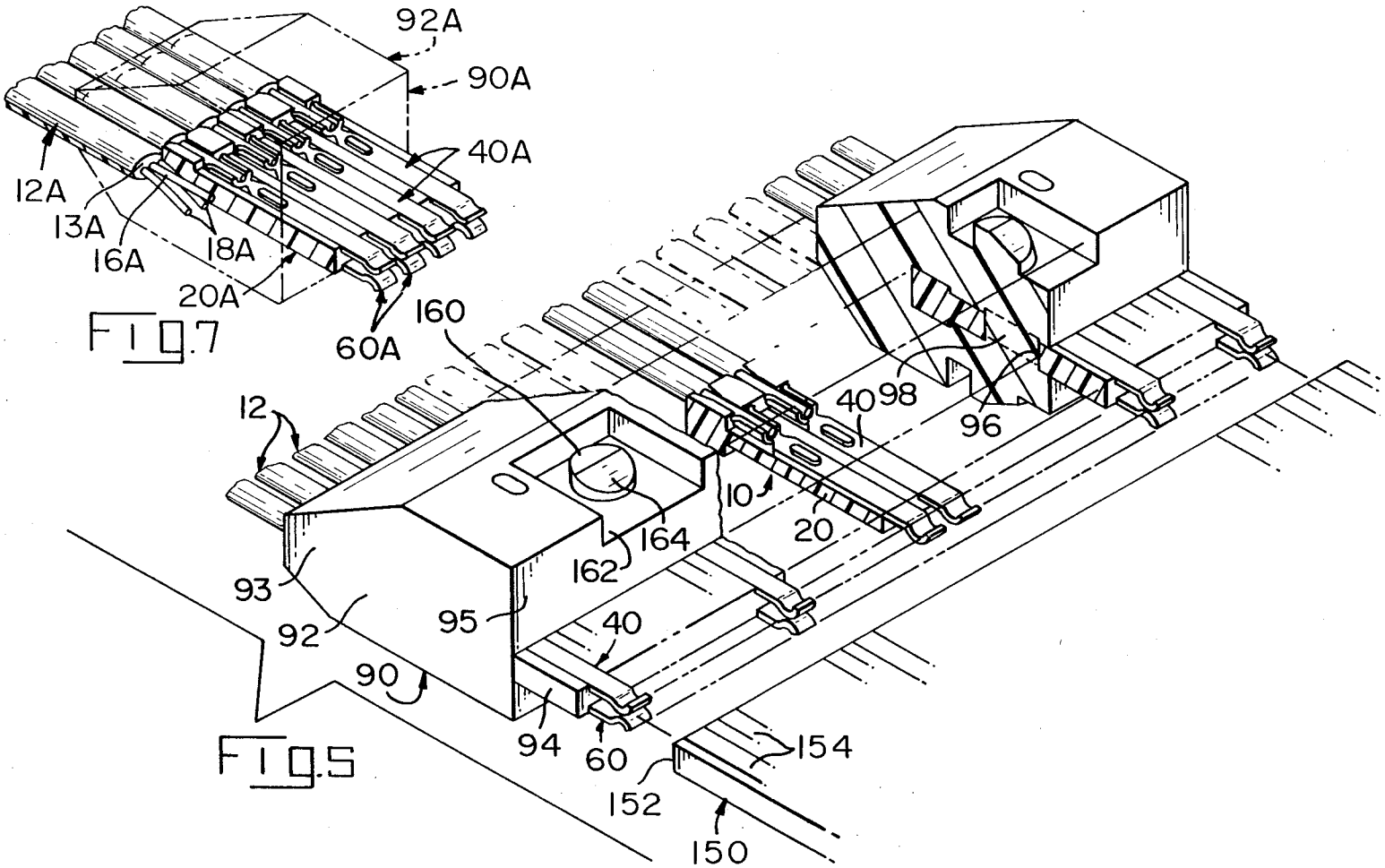
FIG. 5 is a part perspective view of the overmolded contact subassembly with a card edge inserted therein.
FIG. 7 is a part perspective view of the connector used with ribbon cable.

Ground contact sections 64 have contact surfaces 70 on opposing upwardly arcuate sections 72 and also have short downwardly directed ends 74. Opposing pairs of signal and ground contact sections cooperate to receive an edge portion of a printed circuit board (as shown in FIG. 5) and electrically engage respective conductors on side surfaces thereof. Contact surfaces 50, 70 may be gold-plated, if desired.

Figure 3:
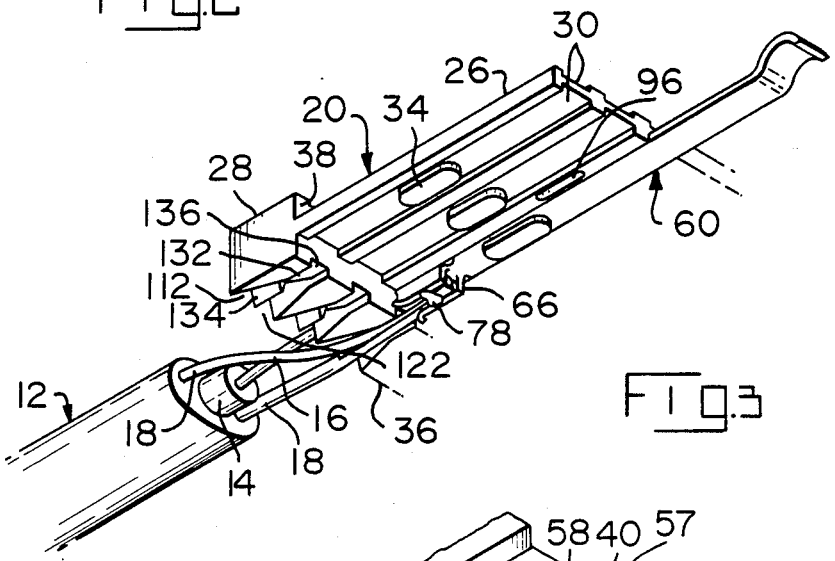
FIG. 3 is a perspective view from below of the termination section.
Figure 4:
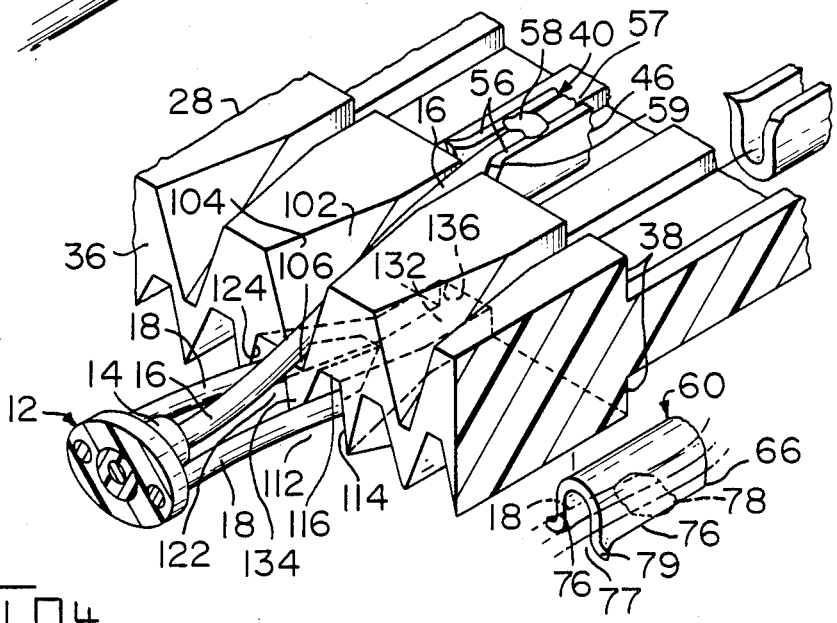
FIG. 4 is an enlarged perspective view of the termination section from rearwardly below.

FIGS. 3 and 4 illustrate in detail the structure and arrangement of conductor-connecting sections 46, 66 of signal and ground contacts 40, 60 and conductor-receiving portion 28 of contact-carrying member 20. Electrical cables 12 each have an insulated signal conductor 14 with a stripped end 16, and ground wires 18 disposed on sides of insulated signal conductor 14, each signal conductor end 16 to be terminated to a signal contact 40 and both associated ground conductor ends 18 to be terminated to an associated ground contact 60.

Located on conductor-positioning portion 28 of contact-carrying member 20, and associated with each cable 12 is an upper or signal channel 102, and preferably two lower ground channels 112, 122 which converge into a single main ground channel 132. Such geometry is preferred in order to facilitate automated assembly and termination. Each signal channel 102 extends from a preferably chamfered lead-in 104 at rearward end 36 of conductor-positioning portion 28 forwardly to an upper portion of forward end 38 thereof, and has a channel bottom 106 which first inclines for a selected distance and then extends horizontally forward. Each signal channel 102 preferably is slightly wider than the diameter of a stripped signal conductor end 16 to be disposed therein.

Paired ground channels 112, 122 are preferably separated at rearward end 36 by pyramidal land 134, then extend forwardly therefrom to converge into a single channel 132 which extends forwardly to a lower portion of forward end 38 of conductor-positioning portion 28. Ground channels 112, 122 have declining channel bottoms 116, 126, that is, which proceed downwardly towards a lower outer surface of portion 28 until converging, and then horizontally forwardly therefrom in a single wide channel bottom 136 and essentially opposed from a corresponding signal channel 102 thereabove and being wide enough for two ground conductors to extend therealong side-by-side. Ground channels 112, 122 preferably have chamfered lead-ins 114, 124. Alternatively, a single ground channel may be provided for each pair of ground conductors 18 which has a wide chamfered lead-in and no pyramidal land.

Disposed just forwardly of forward end 38 and associated and aligned with each signal channel 102 is a conductor-connecting section 46 of a signal contact 40 so that stripped signal conductor end 16 may be disposed along channel bottom 104 and be securable to section 46 of signal contact 48 such as by crimping, soldering or welding. Similarly, disposed just forwardly of forward end 38 and associated and aligned with each main ground channel 132 is a conductor-connecting section 66 of a ground contact 60, and both ground conductors 18 of a cable 12 may be disposed slightly angled toward each other to enter angled lead-ins 114, 124 and extend first each along an associated channel bottom 116 or 126 and then together along channel bottom 136 and be securable to section 66 of ground contact 60.

It is preferred that conductor-connecting sections 46 be ferrule members each having sidewalls 56 defining a longitudinal groove 57 therebetween formed therein within which a signal conductor 16 is disposed and preferably welded, and most preferably, laser welded. For laser welding it is preferred that each conductor end 16 be secured in interference fit proximate the top of groove 57 such as is shown in FIG. 4, and welded at weld 58. Grooves 57 need only have a depth equal to half the diameter of conductor ends 16; grooves 57 as shown are preferably deeper and have sidewalls 56 spaced a width apart just less than the diameter of a conductor end 16 and act with light spring action to retain conductor end 16 therein in interference fit proximate the top edges thereof for laser welding, with the conductor wiped thereinto forwardly from rearward lead-in 59 by tooling (not shown).

Similarly, it is preferred that conductor-connecting sections 66 be ferrule members each having sidewalls 76 defining a longitudinal groove 77 therebetween formed therein within which an associated pair of ground conductor ends 18 may be disposed in side-by-side relationship for, most preferably, laser welding at weld 78. For laser welding it is preferred that paired ground conductors 18 be disposed in groove 77 forwardly of formed rearward lead-in 79 proximate the top edges of sidewalls 76 and held there in interference fit by slight spring action of sidewalls 76 which are a width apart just less than twice the diameter of a ground conductor end 18.

Laser welding, the preferred termination technique herein, is generally known, and is discussed extensively in *Materials Processing Theory and Practices, Volume* 3: *Laser Materials Processing,* (edited by M. Bass, North-Holland Publishing Company, 1983) especially Chapter 3, "Laser Welding," J. Mazumber, pp. 113–200. In particular, laser welding in electronics is described in *Electronics,* Sept. 22, 1981 in an article by Henderson on Pages 149–154 entitled "Dual Lasers Speed Termination of Flexible Printed Wiring."

Figure 6:
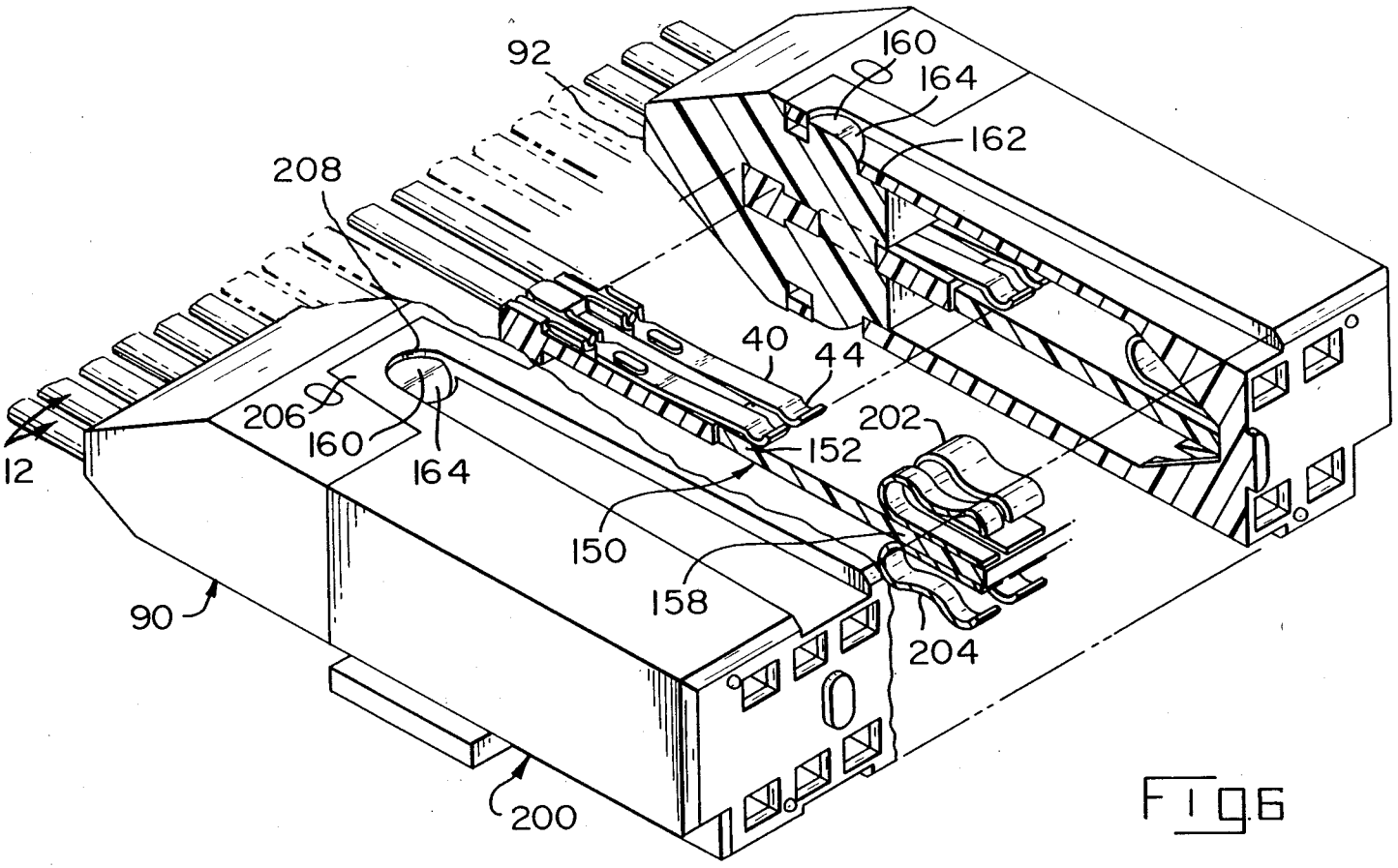
FIG. 6 is a part perspective view of the connector of FIG. 5 mated with a card edge and latched to a double row socket connector.

Referring now to FIG. 5, with signal and ground conductors of cables 12 now terminated to signal and ground contacts secured to contact-carrying member 20 to form contact subassembly 10, subassembly 10 and adjacent portions of cables 12 are placed in a mold (not shown). A polymerizable dielectric material such as polypropylene is now injected into the mold and overmolded around subassembly 10 and adjacent portions of cables 12 to form an overmolded profiled housing 92 for contact assembly 90. Housing 92 sealingly secures terminated conductors 16, 18 and conductor-connecting sections 46, 66. A rearward portion 93 extends along adjacent portions of cables 12 and preferably between cables 12 to provide strain relief therefor. A forward portion 94 of contact assembly 90 extends forwardly beyond a forward surface 95 of overmolded housing 92 to allow for slight outward urging apart of paired signal and ground contact sections 44, 64 by edge portion 152 of a board 150, as shown in FIG. 6. Conductors 154 are disposed on side surfaces of edge portion 152. Further, it is preferred that spaced holes 96 be provided through contact-carrying member 20 intermediate selected contacts and laterally along member 20, positioned just rearwardly from forward surface 95 of overmolded housing 92, so that overmolding material may be forced thereinto so that the upper and lower surfaces may be integrally connected to each other by bridges 98 to give added strength when paired signal and ground spring arm contact sections 44, 64 are urged apart.

A variety of features may be molded into or onto the outer surfaces of the overmolded housing 92, especially to provide latching means or polarizing means or both for physically connecting with a mating connector. One such mating connector 200 is illustrated in FIG. 6, which is a double row socket connector having two rows of paired signal and ground spring contacts 202, 204 which electrically engage respective conductors on side surfaces of opposing edge portion 158 of board 150 which electrically connects mating connector 200 with contact assembly 90. Outwardly extending latching projections 160 are disposed in recesses 162 of upper and lower surfaces of overmolded housing 92, and have forwardly facing beveled camming surfaces 164, so that latching with mating connector 200 occurs when cooperating latching means 206 extending forward from the periphery of mating connector 200 engage and ride over camming surfaces 164 and have holes 208 into which latching projections 160 then extend in a latching engagement.

In another embodiment of the contact assembly of the invention not shown, the contact assembly of the invention may be electrically engaged to an edge portion of a board which electrically connects the assembly with another card edge connector such as one mounted onto a printed circuit board such as by posts extending through plated through-holes of the board. A separate housing member comprising a protective hood for the contact sections extending forwardly of the contact assembly, may be latched to the overmolded housing of the contact assembly similarly to FIG. 6. Latching arms of conventional design may be molded onto the separate housing member to latch to the mating card edge connector. Other latching means or clamping means may be utilized as desired.

FIG. 7 illustrates the connector of the present invention with ribbon cable. Ribbon cable 12A has a plurality of signal conductor ends 16A and ground conductor ends 18A extending forwardly from an outer insulative jacket 13A. Contact assembly 90A is formed secured to ribbon cable 12A in the manner described hereinabove. Signal conductor ends 16A are terminated to signal contacts 40A, and ground conductor ends 18A are terminated to ground contacts 60A, secured to contact-carrying member 20A. Housing 92A is then molded thereover and also over a section of ribbon cable 12A.

Variations in the shape of the spring arm contact sections may also be made within the scope of the present invention without departing from the spirit hereof. It is also within the scope of this invention that signal contacts may be disposed along both upper and lower surfaces of the contact-carrying member and selectively positioned ground contacts placed thereamong as desired, so long as appropriate termination to signal and ground conductors is accomplished. Accordingly, modifications may be made to the design of the conductor-positioning portion of the contact-carrying member.

What is claimed is:

1. A card edge connector for electrically engaging an edge portion of a printed circuit board, said connector being terminated to end portions of conductor means of electrical cable means, comprising:

two rows of aligned contact members secured to and spaced apart by a dielectric contact-carrying member, each said contact member having a planar body section, a conductor-connecting section rearwardly thereof, and a spring arm contact section extending forwardly therefrom, said spring arm contact section first extending toward an opposing spring arm contact section and then diverging therefrom to form a lead-in for a card edge;

said dielectric contact-carrying member having a relatively thin, flat body portion forwardly thereof to receive said contact body section secured against upper and lower surfaces thereof, and a conductor-positioning portion rearwardly thereof to receive, position and align a plurality of said conductor end portions for termination to respective said conductor-connecting sections of said contact members disposed just forwardly of said conductor-positioning portion, said spring arm contact sections extending forwardly of a forward end surface of said contact-carrying member; and a dielectric housing means sealingly surrounding a selected portion of a subassembly comprising said contact-carrying member, said plurality of said contact members secured thereto, said conductor end portions, and sections of said electrical cable means, said selected portion comprising an insulated end length of said electrical cable means, said conductor-positioning portion of said contact-carrying member with said conductor end portions disposed therealong, said conductor-connecting sections of said contact members with respective said conductor end portions terminated thereto, and extending forwardly a selected distance along said body portion of said contact-carrying member and said body sections of said contact members secured therealong, wherein said selected distance is less than the length of said body portion of said contact-carrying member.

2. A card edge connector as set forth in claim 1 further including a hood member secured to said dielectric housing means and extending forwardly therefrom substantially parallel to and at least coextensive with said spring arm contact sections.

3. A card edge connector as set forth in claim 1 wherein said dielectric housing means is overmolded over said selected portion of said subassembly.

4. A card edge connector as set forth in claim 3 wherein said dielectric housing means has at least one integral bridge portion extending through a corresponding hole in said contact-carrying member intermediate adjacent contact members proximate a forward end of said housing means.

5. A card edge connector as set forth in claim 1 wherein said contact-carrying member has projections extending from said upper and lower surfaces thereof through corresponding holes in said body sections of said contact members, said projections having heads which are enlarged to secure said contact members to said contact-carrying member.

6. A card edge connector as set forth in claim 5 wherein said projections are substantially noncircular to prevent rotation of said contact members.

7. A card edge connector as set forth in claim 1 wherein said conductor-positioning portion of said contact-carrying member includes channels for respective said conductor end portions aligned with respective said conductor-connecting sections of said contact members forwardly thereof, each said channel being associated with one of said upper and lower surfaces of said contact-carrying member.

8. A card edge connector as set forth in claim 7 wherein each said channel includes a channel bottom which, proceeding forwardly from a rearward end of said conductor-positioning portion, extends first slopingly toward said one of said upper and lower surfaces of said contact-carrying member and then horizontally forwardly.

9. A card edge connector as set forth in claim 7 wherein said conductor-positioning portion includes adjacent pairs of channels each receiving a respective said conductor end portion, each of which pairs of channels converge forming a single channel along which both said respective conductor end portions are disposed in alignment with a respective said conductor-connecting section of a said contact member.

10. A card edge connector as set forth in claim 7 wherein certain said channels have wide lead-ins to receive a pair of said conductor end portions to be disposed along a single channel bottom of said channel to be terminated to a single conductor-connecting section of a respective contact member aligned therewith forwardly thereof.

11. A card edge connector as set forth in claim 1 wherein said conductor-connecting sections of said contact members comprise ferrules each having a longitudinal groove therealong to receive an associated said conductor end portion for termination therewith.

12. A card edge connector as set forth in claim 1 wherein certain said conductor-connecting sections of said contact members comprise ferrules having a longitudinal groove therealong to receive a pair of said conductor end portions for termination therewith.

13. A card edge connector as set forth in claim 1 wherein said conductor end portions are terminated to said contact members by welding.

14. A card edge connector as set forth in claim 1 wherein said conductor end portions are terminated to said contact members by laser welding.

15. A card edge connector as set forth in claim 1 wherein said conductor means are signal and ground conductors of discrete insulated electrical cables which are terminated to associated said contact members to form signal and ground contact members respectively.

16. A card edge connector as set forth in claim 15 wherein said signal contact members are disposed on one of said upper and lower surfaces of said contact-carrying member, and said ground contact members are disposed on the other of said upper and lower surfaces.

17. A card edge connector as set forth in claim 15 wherein each said electrical cable has a signal conductor and two ground conductors, the end portion of said signal conductor being terminated to an associated signal contact member disposed on one of said upper and lower surfaces of said contact-carrying member and the end portions of said two ground conductors are terminated to a single ground contact member disposed on the other of said uppr and lower surfaces of said contact-carrying member.

18. A card edge connector as set forth in claim 1 wherein said electrical cable means comprises a ribbon cable having signal conductor means and ground conductor means associated with each said signal conductor means, and end portions of said signal and ground conductor means are terminated to associated said contact members to form signal and ground contact members respectively.

19. A dielectric contact-carrying member for an electrical connector comprising a body portion having an upper surface and a lower surface to which are secured body sections of contact members, and a conductor-positioning portion along which are disposed end portions of conductor means of electrical cable means for termination to conductor-connection sections of said contact members disposed just forwardly of said conductor-positioning portion, said conductor-positioning portion including a plurality of conductor channel means extending forwardly from a rearward end thereof in alignment at forward ends thereof with said conductor-connecting sections, at least one said channel means having a rearward channel means to receive two spaced said conductor end portions and having a forward channel section such that said two spaced said conductor end portions may be disposed together along said forward channel section and extending forwardly therefrom for joint termination to a respective conductor-connection section of a said associated contact member.

20. A dielectric contact-carrying member as set forth in claim 19 wherein said two spaced conductor end portions are end portions of a pair of ground conductors both associated with the same signal conductor of said electrical cable means, and said associated contact member is a ground contact.

21. A dielectric contact-carrying member as set forth in claim 19 wherein said rearward channel means comprises a widened lead-in.

22. A dielectric contact-carrying member as set forth in claim 19 wherein said rearward channel means comprises an associated pair of rearward channel sections angled toward each other extending forwardly from said rearward end of said contact-carrying member and converging to enter said forward channel section, such that said two spaced conductor end portions may be disposed first each individually along an associated one of said rearward channel sections and then together along said forward channel section.

* * * * *

UNITED STATES PATENT OFFICE

CERTIFICATE OF CORRECTION

Patent No. 4,579,404 Dated April 1, 1986

Inventor(s) Joseph L. Lockard

It is certified that error appears in the above-identified patent and that said Letters Patent are hereby corrected as shown below:

Claim 1, column 5, line 60, delete "forwardly thereof"; line 61, delete after "said" the word "contact" and after the word "body" delete "section" and add ---sections of said contact members---; line 63, delete "thereof" and add ---therefrom---.

Claim 1, column 6, line 12, after "therealong," add ---and---.

Claim 17, column 7, line 42, change "uppr" to ---upper---.

Signed and Sealed this

*Twenty-ninth* Day of *July 1986*

[SEAL]

*Attest:*

DONALD J. QUIGG

*Attesting Officer* *Commissioner of Patents and Trademarks*